US008090588B2

(12) United States Patent
Ojala et al.

(10) Patent No.: US 8,090,588 B2
(45) Date of Patent: Jan. 3, 2012

(54) SYSTEM AND METHOD FOR PROVIDING AMR-WB DTX SYNCHRONIZATION

(75) Inventors: Pasi Ojala, Kirkkonummi (FI); Ari Lakaniemi, Helsinki (FI)

(73) Assignee: Nokia Corporation, Espoo (FI)

( * ) Notice: Subject to any disclaimer, the term of this patent is extended or adjusted under 35 U.S.C. 154(b) by 798 days.

(21) Appl. No.: 12/199,735

(22) Filed: Aug. 27, 2008

(65) Prior Publication Data

US 2009/0063165 A1 Mar. 5, 2009

Related U.S. Application Data

(60) Provisional application No. 60/969,347, filed on Aug. 31, 2007.

(51) Int. Cl.
*G10L 21/00* (2006.01)

(52) U.S. Cl. ..... 704/500; 704/229; 370/477

(58) Field of Classification Search ..... 704/229, 704/500; 370/477

See application file for complete search history.

(56) References Cited

U.S. PATENT DOCUMENTS

| | | | | |
|---|---|---|---|---|
| 6,504,838 | B1 | 1/2003 | Kwan | |
| 2005/0267746 | A1 | 12/2005 | Jelinek | |
| 2006/0040698 | A1 * | 2/2006 | Shiu et al. | 455/522 |
| 2007/0064681 | A1 * | 3/2007 | Boillot et al. | 370/352 |
| 2008/0010064 | A1 * | 1/2008 | Takeuchi et al. | 704/229 |
| 2008/0233995 | A1 * | 9/2008 | Shiu et al. | 455/522 |

OTHER PUBLICATIONS

Office Action for Chinese Patent Application No. 200880104750.6, dated Aug. 3, 2011.

English translation of Office Action for Chinese Patent Application No. 200880104750.6, dated Aug. 3, 2011.

Zhou, Dejun, "Discontinous Transmission in Speech Communication", Communication Technologies, Issue 9, pp. 46-48, Dec. 31, 2001.

Digital Cellular Telecommunications (Phase2+); Universal Mobile Telecommuications System (UMTS); Speech codec speech processing functions; Adaptive Multi-Rate—Wideband (AMR-WB) speech codec; Source controlled rate operation (3GPP TS 26.193 version (7.0.0 Release 7).

Bruno Bessette et al. "The Adaptive Multirate Widebandspeech Codec (AMR-WB)" IEEE Transactions on Speech and Audio Processing, IEEE Service Center, New York, NY vol. 10, No. 8, Nov. 1, 2002.

International Search Report for PCT Application No. PCT/IB2008/053459 mailed Feb. 6, 2009.

Office Action for Korean Patent Application No. 10-2010-7006843, dated May 30, 2011.

English translation of Office Action for Korean Patent Application No. 10-2010-7006843, dated May 30, 2011.

* cited by examiner

*Primary Examiner* — Daniel D Abebe
(74) *Attorney, Agent, or Firm* — AlbertDhand LLP

(57) ABSTRACT

A system and method for providing improved adaptive multi-rate wideband (AMR-WB) discontinuous transmission (DTX) synchronization. According to various embodiments, an indication on the start of the inactive speech period is signalled to the decoder via a voice activity detection (VAD) flag a predetermined number of frames before the DTX period will start, i.e., before the SID_FIRST frame is received. When the VAD flag indicates active speech, or when the VAD flag has been set to zero less than the predetermined number of frames ago, the received NO_DATA frame can be classified with a high degree of reliability as active speech, i.e., considered as transmitter, network or terminal-initiated signalling, and can be substituted by a SPEECH_LOST frame. When the VAD flag was set to zero eight frames ago or earlier, the NO_DATA frame is classified as DTX.

19 Claims, 4 Drawing Sheets

SYSTEM AND METHOD FOR PROVIDING AMR-WB DTX SYNCHRONIZATION

CROSS-REFERENCE TO RELATED APPLICATIONS

The present application claims priority to U.S. Provisional Patent Application No. 60/969,347, filed Aug. 31, 2007, the contents of which are hereby incorporated herein by reference.

FIELD OF THE INVENTION

The present invention relates to generally to speech coding. More particularly, the present invention relates to speech coding, error resiliency, and the transmission of speech over circuit switched networks such as Tandem free operation (TFO), Transcoder free operation (TrFO) networks and packet switched networks such as Voice over IP (VoIP) networks.

BACKGROUND OF THE INVENTION

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

TFO and TrFO in a 3rd Generation Partnership Project (3GPP) core network, as well as the receiver logic in services such as VoIP services, may inject empty frames or packets passed to a speech coder with a transmission code RX_NO_DATA into the adaptive multi-rate wideband (AMR-WB) bit stream. In other words, an active speech bitstream may occasionally contain empty frames or packets. These empty frames or packets are typically used for other purposes. For example, such frames or packets are often replaced with urgent signalling data such as TFO/TrFO signalling or other system-level signalling. In order to avoid having the decoder process such "non-speech" data frames/packets as speech frames/packets, they are labelled as RX_NO_DATA. In another example of reception of a RX_NO_DATA frame, a frame that is lost or corrupted along the transmission path may be replaced with a RX_NO_DATA frame, e.g., by some intermediate entity.

When an AMR-WB decoder receives a RX_NO_DATA frame within a segment of active speech when discontinuous transmission (DTX) operation is enabled, an AMR-WB decoder implementation according to TS 26.173 v7.0.0 (fixed point implementation) and TS 26.204 v7.0.0 (floating-point implementation) may mute or attenuate the output of the speech synthesis, sometimes for a period of up to 100 ms. This muting or attenuation of the output causes issues relating to significant speech quality degradation.

The intended AMR-WB decoder functionality, according to TS 26.193 v7.0.0, "Source controlled rate operation," notes that NO_DATA frames received when the decoder is in a SPEECH mode should be treated as SPEECH_LOST frames from a DTX handler perspective. In particular, TS 26.193 v7.0.0 states "if the RX DTX handler is in mode SPEECH, then frames classified as SPEECH_DEGRADED, SPEECH_BAD, SPEECH_LOST or NO_DATA shall be substituted and muted as defined in 3GPP TS 26.191. Frames classified as NO_DATA shall be handled like SPEECH_LOST frames without valid speech information."

It may be desirable for the AMR-WB decoder to be made robust so that it can handle any frame type input combination that may be created by the network or created by implementations in terminals/gateways. However, certain problems arise in the case of DTX synchronization. The AMR-WB encoder has voice activity detection (VAD) functionality that detects inactive speech, and the AMR-WB encoder sets the VAD flag to zero accordingly in order to indicate a frame containing inactive speech. The discontinuous transmission (DTX) functionality is invoked after the DTX hangover period of eight frames, during which the comfort noise parameters are determined. The decoder needs to be synchronized with the encoder with regard to this DTX hangover. If the decoder is not so synchronized, the comfort noise calculation in the decoder will be misaligned with the encoder.

Conventionally, the received NO_DATA frame is simply classified as a frame belonging to a DTX period, i.e. indicating that there was no transmission. However, a problem arises in this situation because, although the transmitter or network was transmitting signaling frames, the DTX synchronization logic is misaligned. The synchronization is restored after the first Silence Descriptor (SID) frame containing the comfort noise parameters is received. On the other hand, when the NO_DATA frame is classified as part of active speech bit stream and is replaced by the SPEECH_LOST frame type (and therefore by an error concealment operation in the decoder) a problem can arise with the DTX handling. For example, if the receiver has lost the SID_FIRST frame (the first frame of a DTX period), then the NO_DATA frame is erroneously classified as a lost speech frame. Again, the synchronization is restored after the next SID_UPDATE has been received.

In a fixed-point AMR-WB reference implementation (3GPP TS 26.173), the handling of this DTX synchronization is implemented in c-code, as shown in Example 1 below (function "rx_dtx_handler" in source file "dtx.c").

EXAMPLE 1

```
1 if ((sub(frame_type, RX_SID_FIRST) == 0) ||
2        (sub(frame_type, RX_SID_UPDATE) == 0) ||
3        (sub(frame_type, RX_SID_BAD) == 0) ||
4        (sub(frame_type, RX_NO_DATA) == 0))
5 {
6        encState = DTX;          move16( );
7 } else
8 {
9        encState = SPEECH;          move 16( );
10 }
```

At lines 1-3 of the above, the algorithm checks to see if the frame is a SID_FIRST frame, a SID_UPDATE frame or a corrupted SID frame. At line 4, the algorithm determines if this frame is a NO_DATA frame. If one or more of these conditions are true, then the decoder switches into (or stays in) the DTX state. Based on this piece of source code, it is clear that if a NO_DATA frame is inserted instead of a speech frame being dropped to make room for signaling data in a middle of a segment of active speech, the decoder will erroneously switch to DTX mode even though the correct action would be to stay in speech state.

One prior suggestion for handling the above situation is depicted in Example 2 below.

EXAMPLE 2

```
1 if ((sub(frame_type, RX_SID_FIRST) == 0) ||
2         (sub(frame_type, RX_SID_UPDATE) == 0) ||
3         (sub(frame_type, RX_SID_BAD) == 0) ||
4         ((sub(frame_type, RX_NO_DATA) == 0) &&
4b                (sub(st->dtxGlobalState, SPEECH) != 0)))
5 {
6         encState = DTX;          move16( );
7 } else
8 {
9         encState = SPEECH;          move16( );
10 }
```

Although the text in line 4b above ensures that NO_DATA that might be inserted in the middle of a segment of active speech does not cause erroneous switching into DTX state, this still does not fully solve the problem of incorrect handling of an inserted NO_DATA frame.

SUMMARY OF THE INVENTION

Various embodiments of the present invention provide a system and method for providing improved AMR-WB DTX synchronization. According to various embodiments, the AMR-WB bitstream at issue contains the VAD flag information for each transmitted frame. In other words, the indication on the start of the inactive speech period is signalled to the decoder eight frames before the DTX period will start, i.e., before the SID_FIRST frame is received. Therefore, when the VAD flag indicates active speech or the flag has been set to zero less than eight frames ago, a received NO_DATA frame can be classified with a high degree of reliability as active speech, i.e., considered as transmitter, network or terminal-initiated signalling, and can be substituted by SPEECH_LOST. When the VAD flag was set to zero eight frames ago or earlier, the NO_DATA frame is classified as DTX. With the various embodiments of the present invention, the AMR-WB receiver is more robust for NO_DATA frame handling. Various embodiments of the present invention are applicable in AMR-WB decoders and particularly in DTX comfort noise generation and synchronization.

These and other advantages and features of the invention, together with the organization and manner of operation thereof, will become apparent from the following detailed description when taken in conjunction with the accompanying drawings, wherein like elements have like numerals throughout the several drawings described below.

DETAILED DESCRIPTION OF VARIOUS EMBODIMENTS

Various embodiments of the present invention provide a system and method for providing improved AMR-WB DTX synchronization. According to various embodiments, the AMR-WB bitstream at issue contains the VAD flag information for each transmitted frame. In other words, the indication on the start of the inactive speech period is signalled to the decoder eight frames before the DTX period will start, i.e., before the SID_FIRST frame is received. Therefore, when the VAD flag indicates active speech or the flag has been set to zero less than eight frames ago, the received NO_DATA frame can be classified with a high degree of reliability as active speech, i.e., considered as transmitter, network or terminal-initiated signalling, and can be substituted by SPEECH_LOST. When the VAD flag was set to zero eight frames ago or earlier, the NO_DATA frame is classified as DTX.

Figure 1:
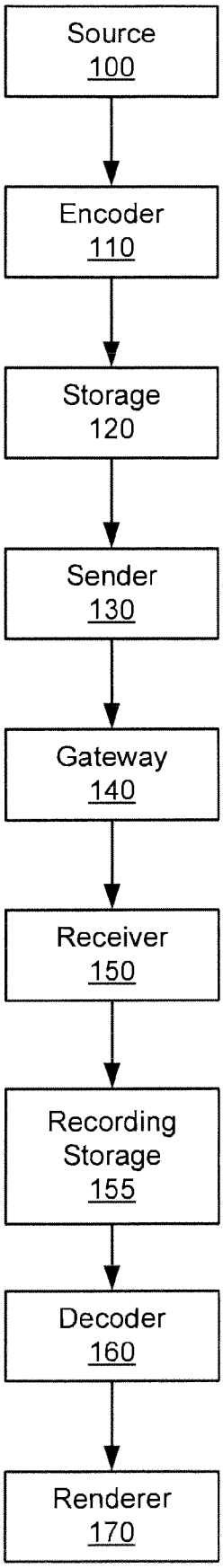
FIG. 1 is an overview diagram of a system within which various embodiments of the present invention may be implemented.

FIG. 1 is a graphical representation of a generic multimedia communication system within which various embodiments of the present invention may be implemented. As shown in FIG. 1, a data source 100 provides a source signal in an analog, uncompressed digital, or compressed digital format, or any combination of these formats. An encoder 110 encodes the source signal into a coded media bitstream. It should be noted that a bitstream to be decoded can be received directly or indirectly from a remote device located within virtually any type of network. Additionally, the bitstream can be received from local hardware or software. The encoder 110 may be capable of encoding more than one media type, or more than one encoder 110 may be required to code different media types of the source signal. The encoder 110 may also get synthetically produced input, such as graphics and text, or it may be capable of producing coded bitstreams of synthetic media. In the following, only processing of one coded media bitstream of one media type is considered to simplify the description. It should be noted, however, that typically real-time broadcast services comprise several streams (typically at least one audio, video and text sub-titling stream). It should also be noted that the system may include many encoders, but in FIG. 1 only one encoder 110 is represented to simplify the description without a lack of generality. It should be further understood that, although text and examples contained herein may specifically describe an encoding process, one skilled in the art would understand that the same concepts and principles also apply to the corresponding decoding process and vice versa.

The coded media bitstream is transferred to a storage 120. The storage 120 may comprise any type of mass memory to store the coded media bitstream. The format of the coded media bitstream in the storage 120 may be an elementary self-contained bitstream format, or one or more coded media bitstreams may be encapsulated into a container file. Some systems operate "live", i.e. omit storage and transfer coded media bitstream from the encoder 110 directly to the sender 130. The coded media bitstream is then transferred to the sender 130, also referred to as the server, on a need basis. The format used in the transmission may be an elementary self-contained bitstream format, a packet stream format, or one or more coded media bitstreams may be encapsulated into a container file. The encoder 110, the storage 120, and the sender 130 may reside in the same physical device or they may be included in separate devices. The encoder 110 and sender 130 may operate with live real-time content, in which case the coded media bitstream is typically not stored permanently, but rather buffered for small periods of time in the content encoder 110 and/or in the sender 130 to smooth out variations in processing delay, transfer delay, and coded media bitrate.

The sender 130 sends the coded media bitstream using a communication protocol stack. The stack may include, but is not limited to, Real-Time Transport Protocol (RTP), User Datagram Protocol (UDP), and Internet Protocol (IP), although it is also noted that 3GPP circuit-switched telephony may also be used in the context of various embodiments of the present invention. When the communication protocol stack is packet-oriented, the sender 130 encapsulates the coded media bitstream into packets. For example, when RTP is used, the sender 130 encapsulates the coded media bitstream into RTP packets according to an RTP payload format. Typically, each media type has a dedicated RTP payload format. It should be again noted that a system may contain more than one sender 130, but for the sake of simplicity, the following description only considers one sender 130.

The sender 130 may or may not be connected to a gateway 140 through a communication network. The gateway 140 may perform different types of functions, such as translation of a packet stream according to one communication protocol stack to another communication protocol stack, merging and forking of data streams, and manipulation of data streams according to the downlink and/or receiver capabilities, such as controlling the bit rate of the forwarded stream according to prevailing downlink network conditions. Examples of gateways 140 include MCUs, gateways between circuit-switched and packet-switched video telephony, Push-to-talk over Cellular (PoC) servers, IP encapsulators in digital video broadcasting-handheld (DVB-H) systems, or set-top boxes that forward broadcast transmissions locally to home wireless networks. When RTP is used, the gateway 140 is called an RTP mixer or an RTP translator and typically acts as an endpoint of an RTP connection.

The system includes one or more receivers 150, typically capable of receiving, de-modulating, and de-capsulating the transmitted signal into a coded media bitstream. The coded media bitstream is transferred to a recording storage 155. The recording storage 155 may comprise any type of mass memory to store the coded media bitstream. The recording storage 155 may alternatively or additively comprise computation memory, such as random access memory. The format of the coded media bitstream in the recording storage 155 may be an elementary self-contained bitstream format, or one or more coded media bitstreams may be encapsulated into a container file. If there are many coded media bitstreams associated with each other, a container file is typically used and the receiver 150 comprises or is attached to a container file generator producing a container file from input streams. Some systems operate "live," i.e., omit the recording storage 155 and transfer coded media bitstream from the receiver 150 directly to the decoder 160. In some systems, only the most recent part of the recorded stream, e.g., the most recent 10-minute excerption of the recorded stream, is maintained in the recording storage 155, while any earlier recorded data is discarded from the recording storage 155.

The coded media bitstream is transferred from the recording storage 155 to the decoder 160. If there are many coded media bitstreams associated with each other and encapsulated into a container file, a file parser (not shown in the figure) is used to decapsulate each coded media bitstream from the container file. The recording storage 155 or a decoder 160 may comprise the file parser, or the file parser is attached to either recording storage 155 or the decoder 160.

The codec media bitstream is typically processed further by a decoder 160, whose output is one or more uncompressed media streams. Finally, a renderer 170 may reproduce the uncompressed media streams with a loudspeaker, for example. The receiver 150, recording storage 155, decoder 160, and renderer 170 may reside in the same physical device or they may be included in separate devices.

According to various embodiments, when a AMR-WB decoder receives a NO_DATA frame/packet, the decoder checks the status of VAD flag and the corresponding DTX hangover status. The AMR-WB has a DTX hangover of eight frames. Therefore, the decoder is expecting to receive SID_FIRST as the eighth frame after the VAD flag was set to zero. Since the decoder was already keeping track of the VAD flag history, i.e., the number of consecutive frames having inactive speech, the decoder can estimate the frame that should contain a SID_FIRST and a NO_DATA frame. A representation of this process is as follows:

```
If vad_hist < 8
    NO_DATA frame considered as SPEECH_LOST
    Signalling included in the bit stream
    No DTX hangover information update needed
else
    NO_DATA frame considered as DTX
    DTX hangover information needs to be updated
```

To include the above functionality in the fixed-point 3GPP AMR-WB reference implementation (3GPP TS 26.173), a further modification to the segment of source code of Example 2 discussed previously can be used and is depicted in Example 3 below.

EXAMPLE 3

```
 1 if ((sub(frame type, RX_SID_FIRST) == 0) ||
 2        (sub(frame_type, RX_SID_UPDATE) == 0) ||
 3        (sub(frame_type, RX_SID_BAD) == 0) ||
 4        ((sub(frame_type, RX_NO_DATA) == 0) &&
 4b               ((sub(st->dtxGlobalState, SPEECH) != 0) ||
 4c                  (sub(vad_hist, DTX_HANG_CONST) >= 0))))
 5 {
 6        encState = DTX;          move16( );
 7 } else
 8 {
 9        encState = SPEECH;          move16( );
10 }
```

The source code of lines 4b and 4c are used to ensure that the NO_DATA frame triggers a switching from the speech state to the DTX state only if the VAD flags received in the AMR-WB bitstream indicate that the hangover period is over, i.e., if the current frame would have been the eighth frame after the received VAD indication changed from active speech to non-active speech. Furthermore, the variable vad_hist indicates the number of (consecutive) speech frames received with the VAD flag set to zero. The value of this value can be, for example, computed in function "decoder" (in file "dec_main.c") and passed as an additional parameter to the function "rx_dtx_handler" or computed inside the function "rx_dtx_handler" (provided that the necessary information for the computation of this value is made available) to enable evaluation of the "if" statement of line 4c of Example 3.

Figure 2:
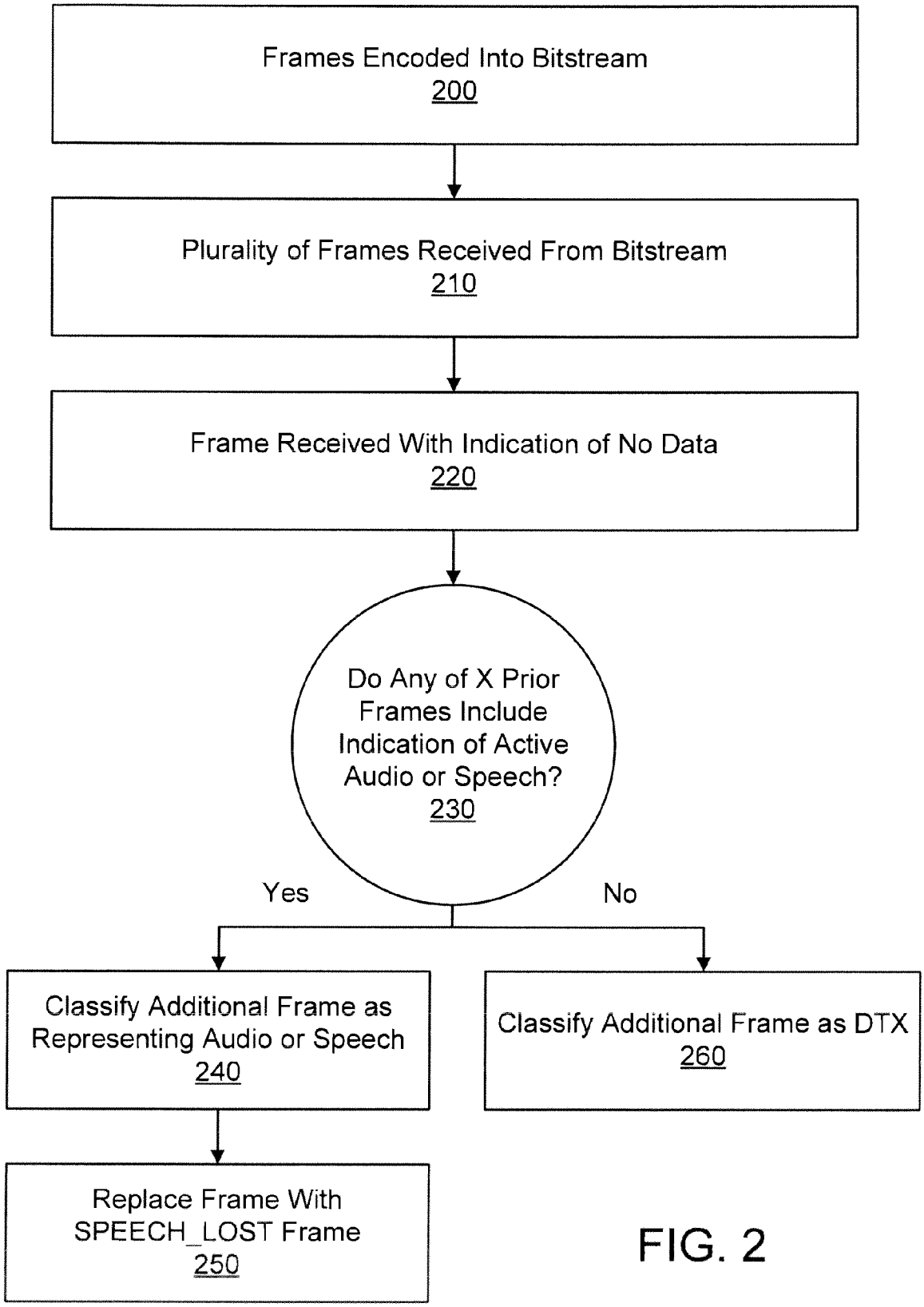
FIG. 2 if a flow chart showing a process by which various embodiments of the present invention may be implemented.

FIG. 2 is a flow chart showing a process by which various embodiments of the present invention may be implemented. At 200 in FIG. 2, individual frames of audio content are encoded into a bitstream. Each of these plurality of frames includes an indication of whether each respective frame represents active speech or other audio, for example by using a VAD flag. At 210, the plurality of frames are received by a decoder. At 220, a frame is received with an indication of indication of no data being contained therein, i.e., being a NO_DATA frame. At 230, it is determined whether at least one of a predetermined previous number (represented by X in FIG. 2) of frames includes an indication that the respective frame represented active audio or speech. As discussed previously, this predetermined number of frames comprises eight frames inclusive in one embodiment of the invention. If at least one of the predetermined previous number of frames includes an indication that the respective frame represented active audio, then at 240 the additional frame is classified as representing active audio. In such a case, the NO_DATA frame may be replaced with a SPEECH_LOST frame at 250. On the other hand, if none of the predetermined previous number of frames includes an indication that the respective frame represented active audio, then at 260 the NO_DATA frame is classified as DTX, indicating a discontinuous transmission.

Figure 3:
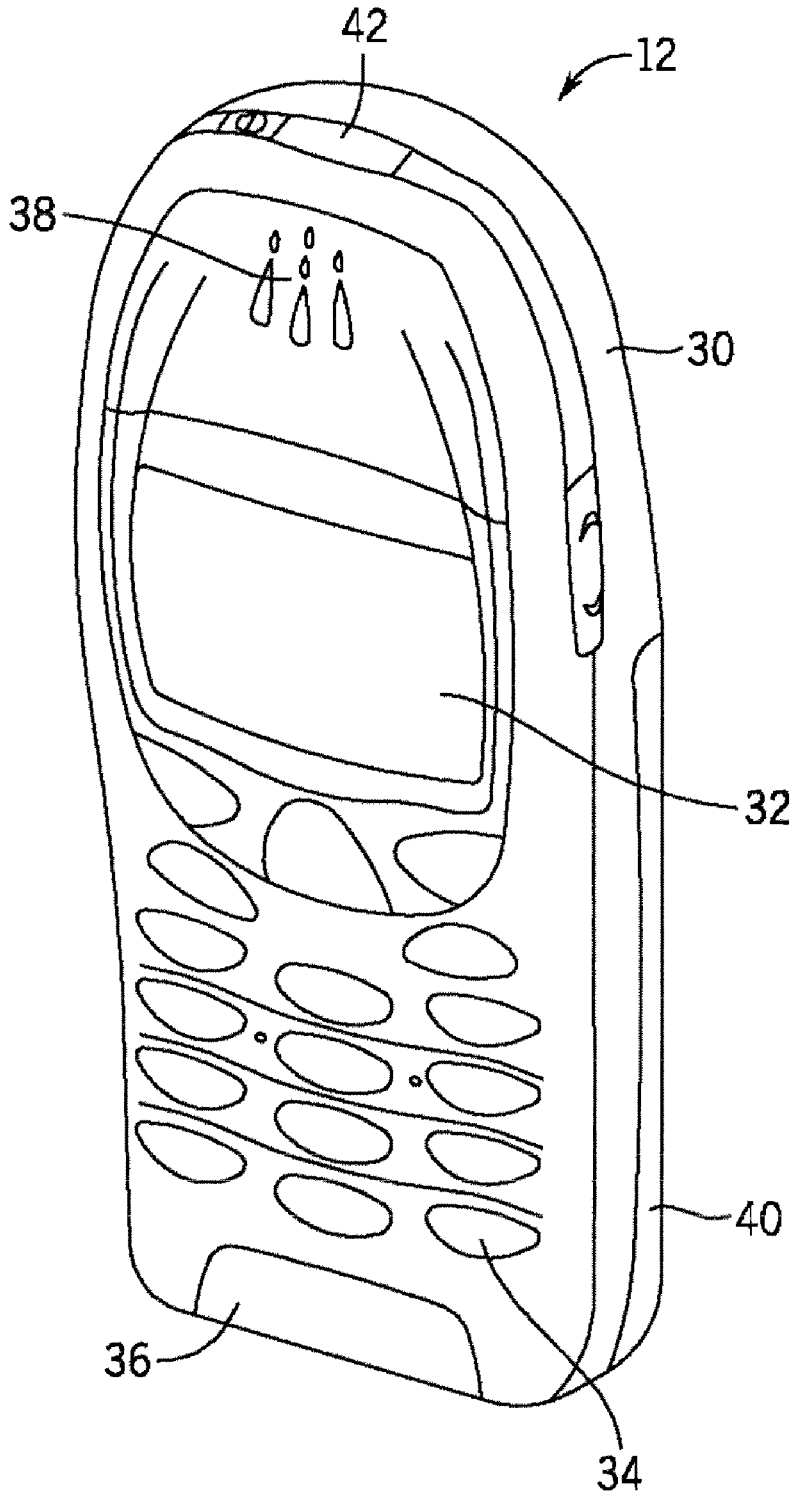
FIG. 3 is a perspective view of an electronic device that can be used in conjunction with the implementation of various embodiments of the present invention.
Figure 4:
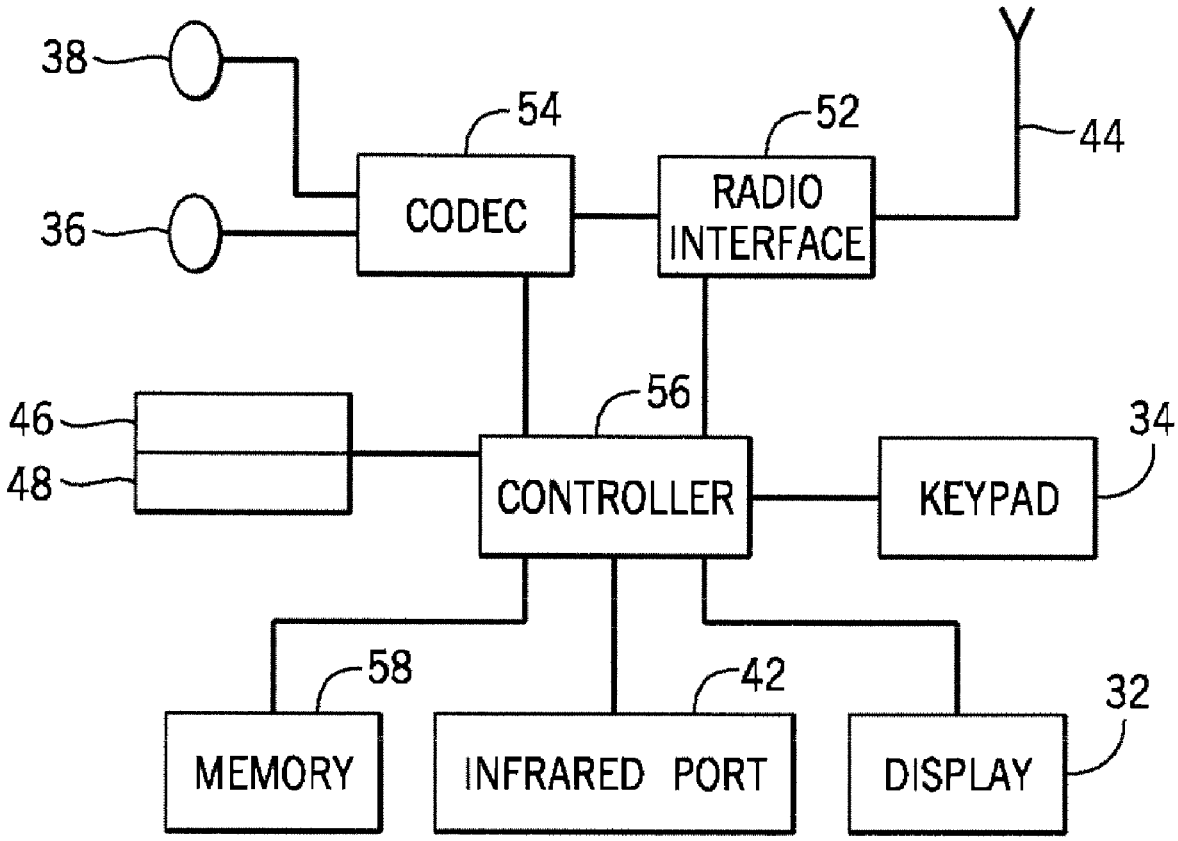
FIG. 4 is a schematic representation of the circuitry which may be included in the electronic device of FIG. 3.

FIGS. 3 and 4 show one representative mobile device 12 within which the present invention may be implemented. It should be understood, however, that the present invention is not intended to be limited to one particular type of electronic device. The mobile device 12 of FIGS. 3 and 4 includes a housing 30, a display 32 in the form of a liquid crystal display, a keypad 34, a microphone 36, an ear-piece 38, a battery 40, an infrared port 42, an antenna 44, a smart card 46 in the form of a UICC according to one embodiment of the invention, a card reader 48, radio interface circuitry 52, codec circuitry 54, a controller 56 and a memory 58. Individual circuits and elements are all of a type well known in the art, for example in the Nokia range of mobile telephones.

The various embodiments of the present invention described herein is described in the general context of method steps or processes, which may be implemented in one embodiment by a computer program product, embodied in a computer-readable medium, including computer-executable instructions, such as program code, executed by computers in networked environments. A computer-readable medium may include removable and non-removable storage devices including, but not limited to, Read Only Memory (ROM), Random Access Memory (RAM), compact discs (CDs), digital versatile discs (DVD), etc. Generally, program modules may include routines, programs, objects, components, data structures, etc. that perform particular tasks or implement particular abstract data types. Computer-executable instructions, associated data structures, and program modules represent examples of program code for executing steps of the methods disclosed herein. The particular sequence of such executable instructions or associated data structures represents examples of corresponding acts for implementing the functions described in such steps or processes.

Software and web implementations of various embodiments of the present invention can be accomplished with standard programming techniques with rule-based logic and other logic to accomplish various database searching steps or processes, correlation steps or processes, comparison steps or processes and decision steps or processes. It should be noted that the words "component" and "module," as used herein and in the following claims, is intended to encompass implementations using one or more lines of software code, and/or hardware implementations, and/or equipment for receiving manual inputs.

The foregoing description of embodiments of the present invention have been presented for purposes of illustration and description. The foregoing description is not intended to be exhaustive or to limit embodiments of the present invention to the precise form disclosed, and modifications and variations are possible in light of the above teachings or may be acquired from practice of various embodiments of the present invention. The embodiments discussed herein were chosen and described in order to explain the principles and the nature of various embodiments of the present invention and its practical application to enable one skilled in the art to utilize the present invention in various embodiments and with various modifications as are suited to the particular use contemplated. The features of the embodiments described herein may be combined in all possible combinations of methods, apparatus, modules, systems, and computer program products.

What is claimed is:

1. A method of decoding audio content, comprising:

receiving a plurality of frames of audio content from a bitstream, each of the plurality of frames including an indication of whether the respective frame represents active audio;

receiving an additional frame of audio content, the additional frame including an indication of no data being contained therein; and if none of the plurality of frames within a predetermined number of frames before the additional frame includes an indication that the respective frame represented active audio, classifying the additional frame as being of a discontinuous transmission.

2. The method of claim 1, further comprising, if at least one of the plurality of frames within the predetermined number of frames before the additional frame includes an indication that the respective frame represented active audio, classifying the additional frame as representing active audio.

3. The method of claim 2, further comprising, if at least one of the plurality of frames within the predetermined number of frames before the additional frame includes an indication that the respective frame represented active audio, substituting the additional frame with a frame specifying that audio has been lost.

4. The method of claim 1, wherein the audio content comprises speech content.

5. The method of claim 1, wherein the predetermined number of frames comprises eight frames.

6. The method of claim 1, wherein the bitstream comprises an adaptive multi-rate wideband bitstream.

7. The method of claim 1, wherein the classifying of the additional frame is performed for discontinuous transmission synchronization.

8. A computer program product, embodied in a computer-readable medium, comprising computer code configured to perform the processes of claim 1.

9. An apparatus, comprising:

an electronic device configured to:

process a received plurality of frames of audio content from a bitstream, each of the plurality of frames including an indication of whether the respective frame represents active audio;

process a received additional frame of audio content, the additional frame including an indication of no data being contained therein; and if none of a plurality of frames within the predetermined number of frames before the additional frame includes an indication that the respective frame represented active audio, classify the additional frame as being of a discontinuous transmission.

10. The apparatus of claim 9, wherein the electronic device is further configured to, if at least one of the plurality of frames within the predetermined number of frames before the additional frame includes an indication that the respective frame represented active audio, classifying the additional frame as representing active audio.

11. The apparatus of claim 10, wherein the electronic device is further configured to, if at least one of the plurality of frames within the predetermined number of frames before the additional frame includes an indication that the respective frame represented active audio, substituting the additional frame with a frame specifying that audio has been lost.

12. The apparatus of claim 9, wherein the audio content comprises speech content.

13. The apparatus of claim 9, wherein the predetermined number of frames comprises eight frames.

14. The apparatus of claim 9, wherein the bitstream comprises an adaptive multi-rate wideband bitstream.

15. The apparatus of claim 9, wherein the classifying of the additional frame is performed for discontinuous transmission synchronization.

16. An apparatus, comprising:

means for receiving a plurality of frames of audio content from a bitstream, each of the plurality of frames including an indication of whether the respective frame represents active audio;

means for receiving an additional frame of audio content, the additional frame including an indication of no data being contained therein; and means for, if none of the plurality of frames within a predetermined number of frames before the additional frame includes an indication that the respective frame represented active audio, classifying the additional frame as being of a discontinuous transmission.

17. The apparatus of claim 16, further comprising means for, if at least one of the plurality of frames within the predetermined number of frames before the additional frame includes an indication that the respective frame represented active audio, classifying the additional frame as representing active audio.

18. The apparatus of claim 17, further comprising means for, if at least one of the plurality of frames within the predetermined number of frames before the additional frame includes an indication that the respective frame represented active audio, substituting the additional frame with a frame specifying that audio has been lost.

19. The apparatus of claim 16, wherein the classifying of the additional frame is performed for discontinuous transmission synchronization.

* * * * *

UNITED STATES PATENT AND TRADEMARK OFFICE

CERTIFICATE OF CORRECTION

PATENT NO. : 8,090,588 B2
APPLICATION NO. : 12/199735
DATED : January 3, 2012
INVENTOR(S) : Ojala et al.

It is certified that error appears in the above-identified patent and that said Letters Patent is hereby corrected as shown below:

In the claims:

Column 8,
Lines 53 and 54, "if none of a plurality of frames within the predetermined number of frames" should read --if none of the plurality of frames within a predetermined number of frames--.

Signed and Sealed this
Twenty-fifth Day of August, 2015

Michelle K. Lee

Michelle K. Lee
*Director of the United States Patent and Trademark Office*